US005974593A

United States Patent [19]

McNabb

[11] Patent Number: 5,974,593

[45] Date of Patent: Nov. 2, 1999

[54] BATTING HELMET WITH CIRCUMFERENTIAL ELASTIC HEAD BAND

[75] Inventor: Garry W. McNabb, Cookeville, Tenn.

[73] Assignee: Adams USA, Inc., Cookeville, Tenn.

[21] Appl. No.: 09/154,884

[22] Filed: Sep. 17, 1998

Related U.S. Application Data

[60] Provisional application No. 60/063,185, Oct. 20, 1997.

[51] Int. Cl.[6] ..... A42B 3/00

[52] U.S. Cl. ..... 2/418; 2/414; 2/425

[58] Field of Search ..... 2/410, 411, 414, 2/417, 418, 425, 419, 420

[56] References Cited

U.S. PATENT DOCUMENTS

| | | | |
|---|---|---|---|
| 2,431,678 | 12/1947 | Cairns | 2/418 |
| 3,087,165 | 4/1963 | Cairns | 2/418 |
| 3,465,363 | 9/1969 | Raney | 2/420 |
| 5,337,420 | 8/1994 | Haysom et al. | 2/410 |
| 5,511,250 | 4/1996 | Field et al. | 2/418 |
| 5,575,017 | 11/1996 | Hefling et al. . | |
| 5,815,847 | 10/1998 | Holden, Jr. | 2/418 |

*Primary Examiner*—Michael A. Neas

*Attorney, Agent, or Firm*—Wheat, Camoriano, Smith & Beres, PLC; Vance A. Smith; David W. Nagle, Jr.

[57] ABSTRACT

A batting helmet includes an adjustable circumferential head band that allows the helmet to be worn by individuals with a wide range of head sizes while maintaining a constant air gap between the wearers head and the interior padding of the helmet. This air gap increases the elapsed time between impact of a ball with the helmet and impact between the helmet and its padding and the wearers head, thereby allowing for increased dispersion of energy through the shell of the helmet.

5 Claims, 3 Drawing Sheets

BATTING HELMET WITH CIRCUMFERENTIAL ELASTIC HEAD BAND

This application claims priority from U.S. provisional application 60/063,185, filed Oct. 20, 1997.

BACKGROUND OF THE INVENTION

Batting helmets are used to reduce the likelihood of head injuries resulting from being struck by a pitched or deflected baseball or softball. These helmets generally are comprised of a polymeric shell lined with appropriate padding. This shell commonly includes a crown portion, a forward extending bill portion, and one or two earflaps that protect the side of the wearer's head. Additionally, some batting helmets may include a face protector to protect the face and jaw of a wearer.

Helmets must fit snugly both to adequately protect the wearer and to prevent the helmet from falling forward over the wearer's eyes. Thus, it is important that a person have the properly sized helmet. While professional and collegiate players may have their own individually fitted batting helmets, youth and little league players seldom have their own helmet. It is common for youth batters to share helmets, and consequently, many do not fit properly, exposing the players to potential injury.

There has been at least one prior art helmet that attempts to solve this problem of ill-fitting helmets by providing for automatic size adjustment. U.S. Pat. No. 5,575,017 issued to Hefling, et al. describes a batting helmet that includes a V-shaped elastic band that automatically adjusts to the size of the wearer's head. This helmet, however, biases the wearer's head toward the front of the helmet. A shock-absorbing air gap is maintained between the sides and rear of the helmet and the wearer's head, but there is no such gap between the front of the helmet and the wearer's head. Without such an air gap, the helmet is not as effective in absorbing the impact of a ball striking the helmet.

It is thus a paramount object of the present invention to provide a batting helmet that provides for automatic size adjustment while maintaining a shock-absorbing air gap around the entire circumference of the wearer's head.

SUMMARY OF THE INVENTION

The present invention overcomes the problems associated with poorly fitting batting helmets without sacrificing the added protection that a uniform shock-absorbing air gap around the entire circumference of the wearer's head provides. Specifically, the present invention is a batting helmet that includes a flexible circumferential head band within the shell of the helmet that allows the helmet to be worn by individuals with a wide range of head sizes while maintaining an air gap between the wearer's head and the interior padding of the helmet. The air gap remains essentially constant around the entire circumference of the wearer's head. The air gap increases the elapsed time between impact of a ball with the helmet and impact between the padding positioned within the helmet and the wearer's head. This longer time period allows for increased dispersion of energy through the shell of the helmet, regardless of the direction from which the helmet is initially impacted.

DESCRIPTION OF THE PREFERRED EMBODIMENTS

Figure 1:
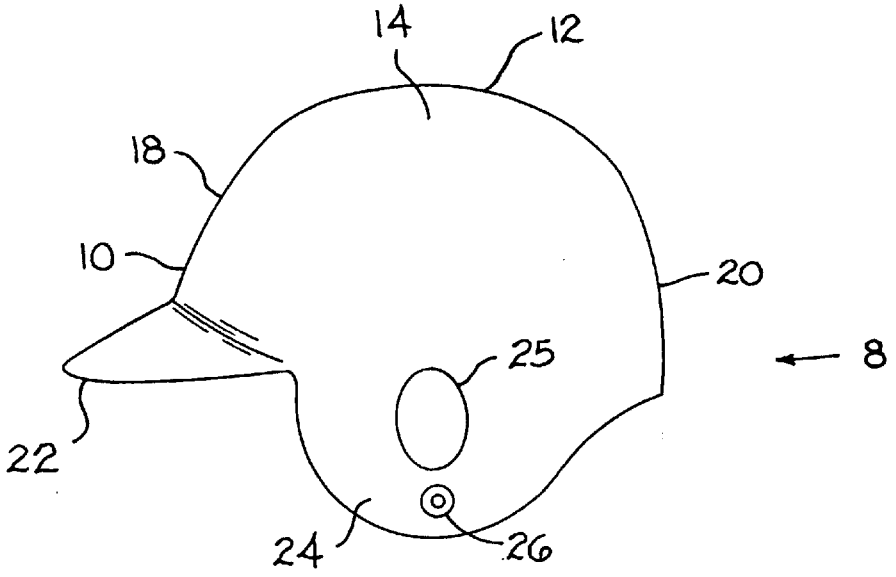
FIG. 1 is a side view of a batting helmet made in accordance with the present invention.
Figure 2:
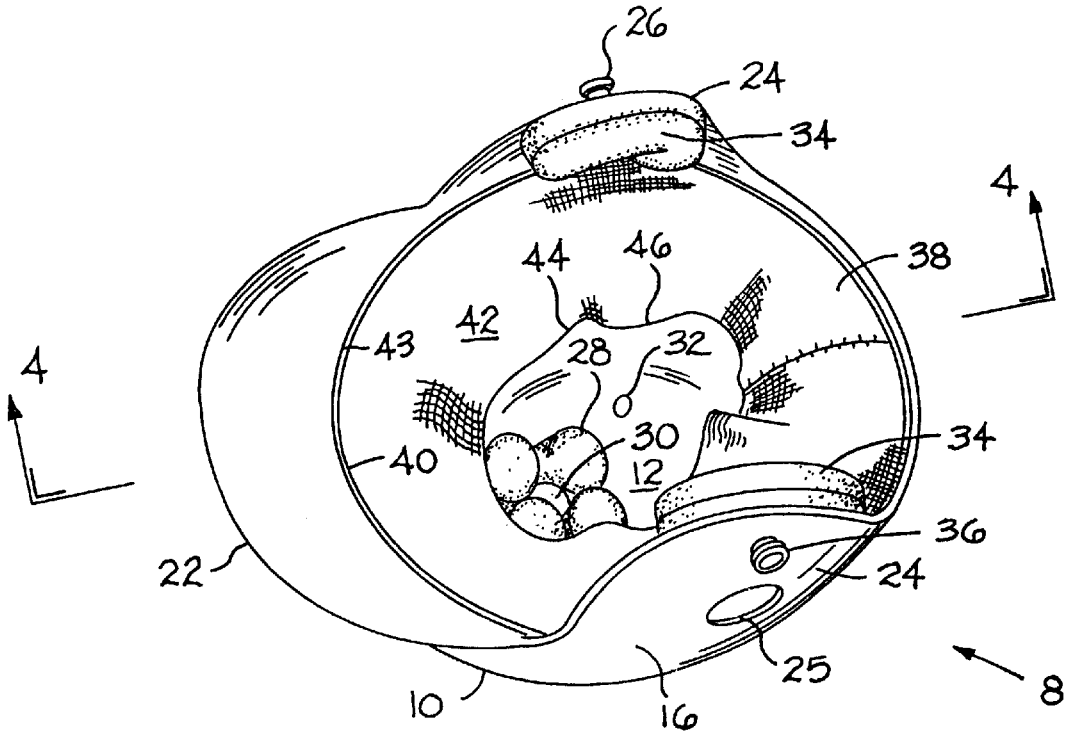
FIG. 2 is a bottom view of the batting helmet of FIG. 1, showing the circumferential head band of the helmet.
Figure 3:
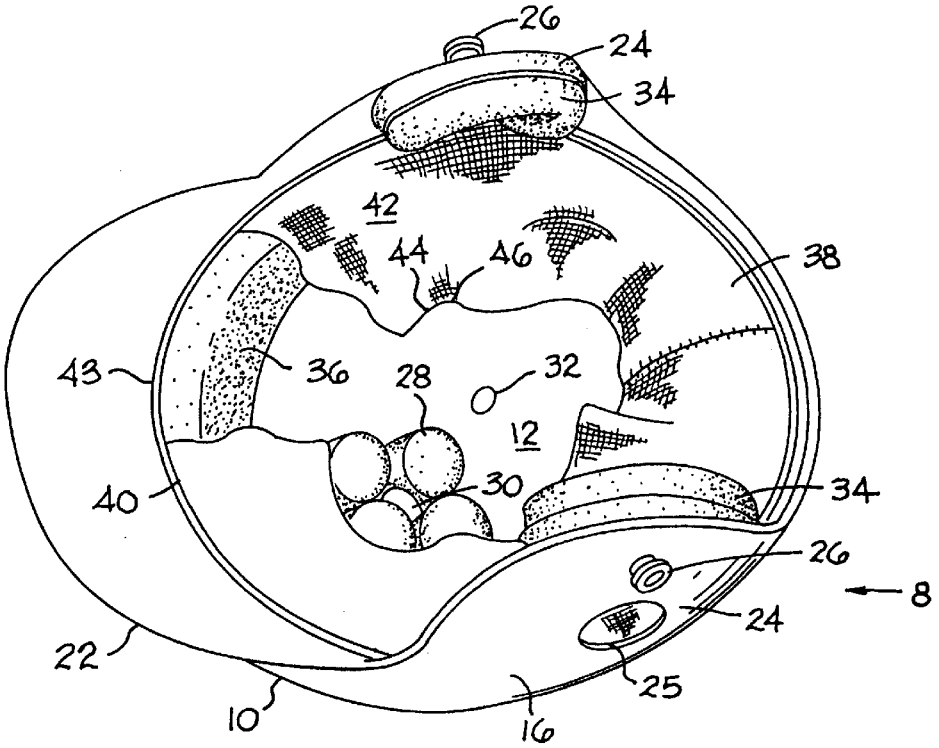
FIG. 3 is a second bottom view of the batting helmet of FIG. 1, wherein a portion of the circumferential head band has been removed to better show the position of the ring pad within the helmet.

FIGS. 1–6 show a preferred embodiment of the present invention. The helmet 8 includes a shell 10, which is preferably constructed of a rigid polymeric material, such as polycarbonate, ABS (acrylonitrile-butadiene-styrene), or a similar alloy. The shell 10 has a crown portion 12, a right side 14, a left side 16 a front portion 18, a back portion 20, a forwardly extending bill 22, and a pair of downwardly extending ear flaps 24. Each year flap 24 defines an ear hole 25 which allows the wearer to hear. At the bottom of each ear flap 24 is a grommet 26 which allows for the optional attachment of a chin strap (not shown).

A series of pads are glued or similarly secured to the interior of the shell 10. A crown pad 28 is secured to the apex of the crown portion 12. This crown pad 28 preferably includes a top hole 30 which extends through the crown portion 12 of the shell 10 to create a passageway for air circulation. The crown portion 12 of the shell 10 may also define additional holes 32 for air circulation. An ear pad 34 is secured to the interior of the shell 10 at the lower end of each of the ear flaps 24. Both the crown pad 28 and the ear pads 34 are preferably partially constructed of a low-density, spongy foam material to provide the wearer with a comfortable fit. Although the crown pad 28 and the ear pads 34 described and shown are preferred, these particular pads could be modified without departing from the spirit and scope of the present invention.

Along the entire interior circumference of the shell 10, just above the bill 22, is a ring pad 36. The ring pad 36 is preferably constructed of a rigid foam material, such as EDP (expanded polypropylene), with a preferred thickness of approximately ⅝". The ring pad 36 serves to absorb the impact of a ball striking the helmet 8.

Secured to the ring pad 36 is an elastic head band 38. The head band 38 has two portions: an outer portion 40 that wraps around the ring pad 36 and is situated between the ring pad 36 and the shell 10, and an inner elastic portion 42 that extends inwardly toward the center of the shell 10. This inner elastic portion 42 accommodates the wearer's head. The outer portion 40 is preferably constructed of a synthetic rubber, such as neoprene, that can be stretched to fit around the ring pad 36. The inner elastic portion 42 is preferably constructed of flexible knit material. The outer portion 40 and inner elastic portion 42 are sewn together along a circumferential edge to form a circumferential seam 43.

Figure 4:
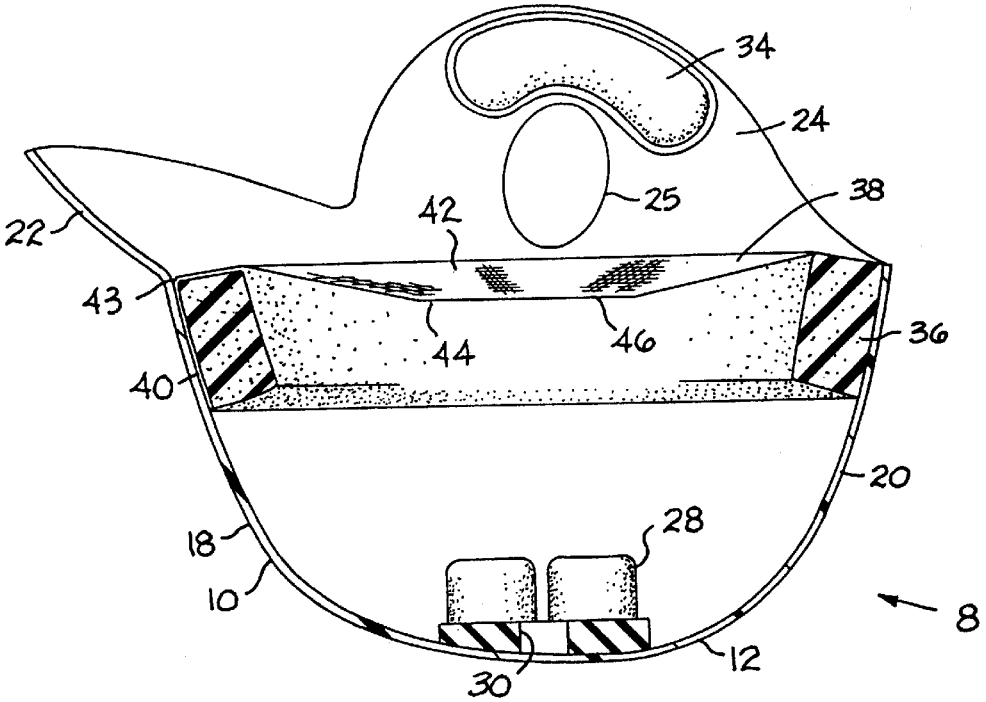
FIG. 4 is a side sectional view of the batting helmet taken along line 4—4 of FIG. 2.

When the outer portion 40 of the head band 38 is stretched and fit over the ring pad 36, the result is that the inner elastic portion 42 is stretched along the circumferential seam 43 between the two portions, but remains relatively un-stretched along its free edge 44. This results in the inner elastic portion 42 of the head band 38 being oriented at an angle with the free edge 44 being biased toward the crown portion 12 of the shell 10, as best shown in FIG. 4.

Figure 5:
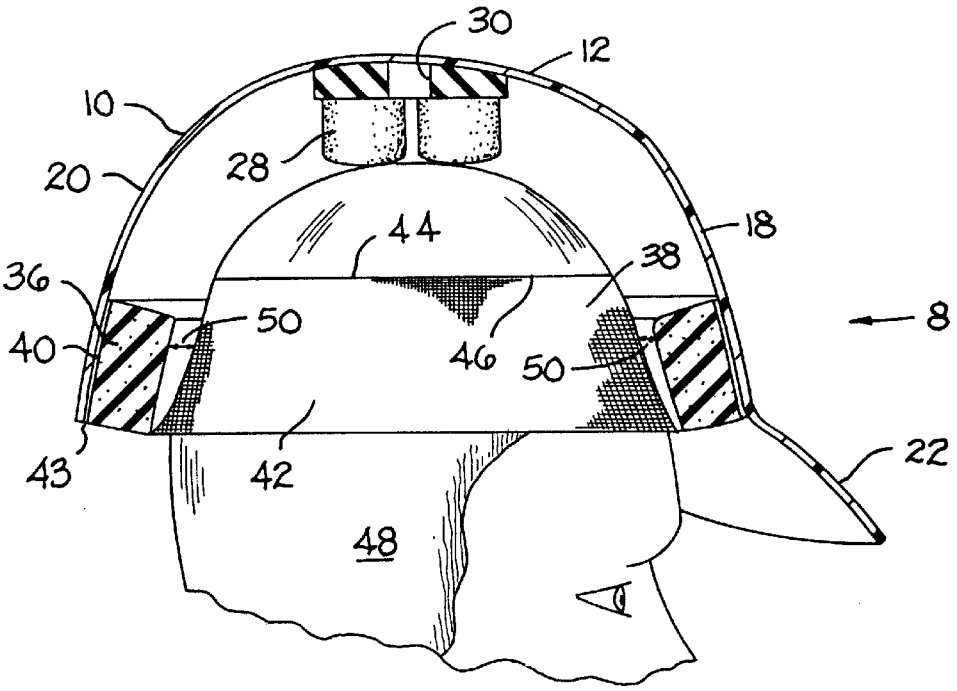
FIG. 5 is a side sectional view of the batting helmet of FIG. 1, wherein an individual is wearing the helmet.
Figure 6:
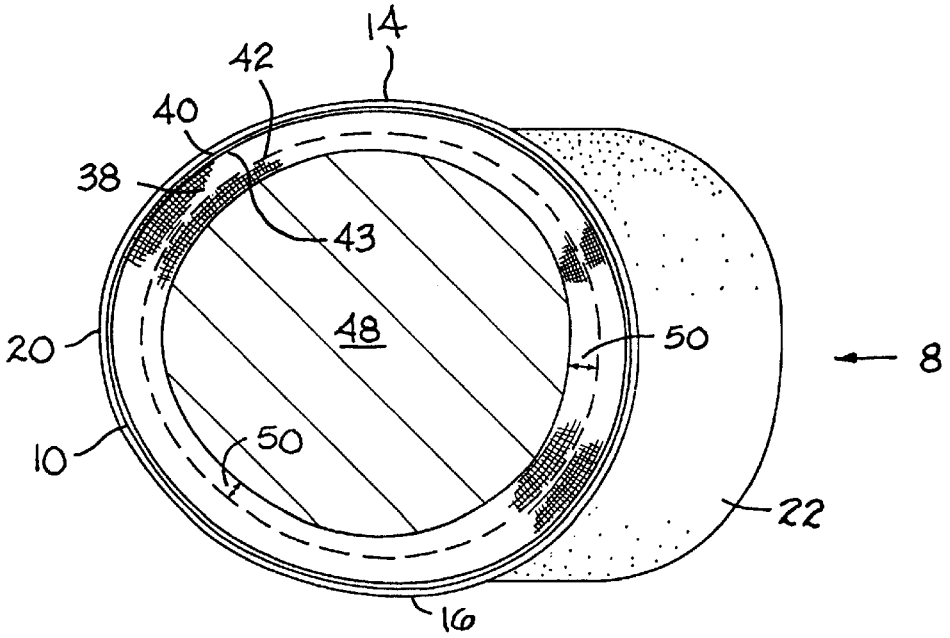
FIG. 6 is a bottom view of the batting helmet of FIG. 5.

Referring now to FIGS. 5 and 6, the free edge 44 of the inner elastic portion 42 of the head band 38 defines an opening 46 for accommodating the wearer's head 48. When a wearer places the helmet 8 on his head, the inner elastic portion 42 of the head band 38 is stretched such that the opening 46 expands to the size of the wearer's head 48. Thus, the head band 38 can accommodate head sizes within a predetermined range. As shown, an air gap 50 is maintained between the wearer's head 48 and the ring pad 36 around the entire circumference of the wearer's head 48. This air gap 50 provides the helmet 8 with improved shock-absorbing characteristics. Specifically, the air gap 50 increases the elapsed time between impact of a ball with the helmet 8 and the impact between the helmet 8 and the wearer's head 48. This increased time period allows the energy of impact against the helmet 8 to be dispersed through the shell 10 of the helmet 8 prior to the impact against the wearer's head, irrespective of the direction that the ball impacts the helmet 8.

It will be obvious to those skilled in the art that modifications may be made to the embodiments described above without departing from the spirit and scope of the present invention.

What is claimed is:

1. A protective helmet adapted to receive a wearer's head for effectively dispersing the energy of impact of an object against the helmet, comprising:

a rigid shell having crown, front, back, left and right portions shaped to protect the respective crown, front, back, left and right portions of the wearer's head, said shell defining a bottom opening and an internal cavity for receiving the wearer's head;

a ring pad positioned within said internal cavity against said shell; and a circumferential head band secured to said shell near said bottom opening, said head band having a flexible portion that defines a central opening for receiving the wearers head, such that, when the wearer's head is received in said central opening, an air gap is maintained between the wearer's head and said ring pad more pads within said shell along the entire circumference of said shell, thereby increasing the time interval between impact of the object against the helmet and impact of said ring pad against the wearer's head.

2. A protective helmet as recited in claim 1, in which said circumferential head band is secured to said ring pad.

3. A protective helmet as recited in claim 2, wherein said circumferential head band further comprises an outer portion that is fitted around said ring pad and is positioned between said ring pad and said shell, said flexible portion being attached to said outer portion along a circumferential seam.

4. A protective helmet as recited in claim 3, wherein the outer portion of said head band is constructed of a synthetic rubber, and wherein the flexible portion of said head band is constructed of a knit material.

5. A protective helmet as recited in claim 4, and further comprising a shock-absorbing crown pad secured to the crown portion of said shell within the internal cavity defined by said shell.

* * * * *

UNITED STATES PATENT AND TRADEMARK OFFICE

CERTIFICATE OF CORRECTION

PATENT NO. : 5,974,593

DATED : NOVEMBER 2, 1999

INVENTOR(S) : McNabb

It is certified that error appears in the above-identified patent and that said Letters Patent is hereby corrected as shown below:

Column 4, lines 8-9, after "said ring pad", delete "more pads".

Signed and Sealed this

Twenty-eighth Day of March, 2000

*Attest:*

Q. TODD DICKINSON

*Attesting Officer*

*Commissioner of Patents and Trademarks*